US012752957B2

(12) United States Patent
Trebino

(10) Patent No.: US 12,752,957 B2
(45) Date of Patent: Oct. 6, 2026

(54) VOLUME-ADJUSTABLE PACKAGE BOX

(71) Applicant: Wolf Rock Design LLC, Carlisle, MA (US)

(72) Inventor: Andrew Trebino, Carlisle, MA (US)

(73) Assignee: Wolf Rock Design LLC, Carlisle, MA (US)

( * ) Notice: Subject to any disclaimer, the term of this patent is extended or adjusted under 35 U.S.C. 154(b) by 0 days.

(21) Appl. No.: 19/130,858

(22) PCT Filed: Nov. 16, 2023

(86) PCT No.: PCT/US2023/080144
§ 371 (c)(1),
(2) Date: May 16, 2025

(87) PCT Pub. No.: WO2024/108041
PCT Pub. Date: May 23, 2024

(65) Prior Publication Data

US 2026/0008583 A1 Jan. 8, 2026

Related U.S. Application Data

(60) Provisional application No. 63/384,018, filed on Nov. 16, 2022.

(51) Int. Cl.
*B65D 5/355* (2006.01)
*B65D 5/20* (2006.01)
(Continued)

(52) U.S. Cl.
CPC ..... *B65D 5/0005* (2013.01); *B65D 5/2033* (2013.01); *B65D 5/5475* (2013.01); *B65D 85/36* (2013.01); *B65D 2585/366* (2013.01)

(58) Field of Classification Search
CPC .. B65D 5/0005; B65D 5/2033; B65D 5/5475; B65D 85/36; B65D 2585/366;
(Continued)

(56) References Cited

U.S. PATENT DOCUMENTS 3,163,344 A 12/1964 Tunick
4,039,120 A * 8/1977 Herzog ..... B65D 5/5445 229/235

(Continued)

OTHER PUBLICATIONS

This pizza box folding hack went viral on TikTok, and people can't believe their eyes, retrieved from the internet, retrieved on May 16, 2025; <URL: https://bgr.com/lifestyle/pizza-box-hack-tiktok-fold-design/>.

*Primary Examiner* — Christopher R Demeree

(57) ABSTRACT

A volume-adjustable package box is a device that can be easily reduced to retain a smaller amount of products. The device includes a foldable piece of boxing material designed to be easily assembled to retain an amount of product. The foldable piece of boxing material also enables the removal of sections of the boxing material to form a smaller package box. The foldable piece of boxing material includes a backing pair of folding lines, a cutaway pair of perforated lines, and a secondary lengthwise-tab-defining folding line. The backing pair of folding lines indicate where the foldable piece of boxing material can be folded to form the backing of the package box. The cutaway pair of perforated lines facilitate the removal of boxing material to reduce the size of the package box. The secondary lengthwise-tab-defining folding line enables the folding of a secondary lengthwise tab for the reduced package box.

14 Claims, 15 Drawing Sheets

(51) Int. Cl.
*B65D 5/54* (2006.01)
*B65D 85/36* (2006.01)

(58) Field of Classification Search
CPC .. B65D 5/546; B65D 2581/3406; B65D 5/54; B65D 5/5495; B65D 5/5445; B65D 81/3453; B65D 81/36; A47G 2021/002; Y02W 30/80
USPC ..... 229/101.2, 235, 906, 239, 902, 903; 206/551; 426/115, 122
See application file for complete search history.

(56) References Cited

U.S. PATENT DOCUMENTS

| | | | | |
|---|---|---|---|---|
| 5,071,062 | A | 12/1991 | Bradley et al. | |
| 5,110,038 | A * | 5/1992 | Pantisano | B65D 5/6626 426/115 |
| 5,375,761 | A * | 12/1994 | Sullivan | B65D 5/545 229/235 |
| 6,440,050 | B1 | 8/2002 | Capparelli et al. | |
| 9,233,515 | B2 * | 1/2016 | Cook | B65D 5/5475 |
| 11,134,802 | B2 * | 10/2021 | Goldberg | B65D 77/245 |
| 2003/0080120 | A1 * | 5/2003 | Whitmore | B65D 5/029 219/730 |
| 2007/0284422 | A1 | 12/2007 | Saunders et al. | |
| 2008/0197177 | A1 * | 8/2008 | Volz | B65D 85/36 229/101.2 |
| 2011/0138750 | A1 | 6/2011 | Walsh | |
| 2013/0068830 | A1 | 3/2013 | Colon | |
| 2014/0191022 | A1 | 7/2014 | Volz et al. | |
| 2020/0262605 | A1 * | 8/2020 | Herkenrath | B65D 5/54 |

* cited by examiner

VOLUME-ADJUSTABLE PACKAGE BOX

The current application is a 371 of international Patent Cooperation Treaty (PCT) application PCT/US2023/080144 filed on Nov. 16, 2022. The PCT application PCT/US2023/080144 claims a priority to a U.S. provisional application Ser. No. 63/384,018 filed on Nov. 16, 2022.

FIELD OF THE INVENTION

The present invention relates generally to storage and packaging devices. More specifically, the present invention provides a package box that can be adjusted to have different levels of storage space.

BACKGROUND OF THE INVENTION

Nowadays, takeout and delivery are the most popular methods for ordering food on the go. For example, most people often place pizza orders for takeout or delivery instead of eating at the restaurant. Most individuals do not finish the pizza order and need to refrigerate the pizza for later consumption. For convenience, most people prefer to store the leftover slices in the same pizza box. However, most pizza boxes can be too large to easily fit inside the refrigerator, which can be frustrating. As a possible solution, many people store the remaining pizza slices in foil, sealable bags, or other storage devices. Unfortunately, these solutions result in bigger waste since more materials are used to store the leftover pizza. Thus, there is a need for a better solution to store leftover pizza without creating more waste.

An objective of the present invention is to provide a volume-adjustable package box that can be configured to retain various amounts of product. The volume-adjustable package box is a sustainable package device that allows the user to adjust the storage space available inside the box so that different amounts of products can be stored inside the package box. Another objective of the present inventio is to provide a volume-adjustable package box that reduces waste while enabling different amounts of products to be stored with the same package box. The present invention allows users to store products such as leftover food using the same package box to avoid using other storage devices. Another objective of the present invention is to provide a volume-adjustable package box that can be easily modified to store the desired amount of products inside the package box. The present invention allows users to remove sections of the package box to reduce the overall size of the package box in order to retain a smaller amount of product. Additional features and benefits of the present invention are further discussed in the sections below.

SUMMARY OF THE INVENTION

The present invention is a volume-adjustable package box that can be used as a sustainable alternative to traditional food packaging for takeout or delivery orders. The volume-adjustable package box is preferably designed as a package box for pizzas but can be modified to store different products. To do so, the present invention includes a foldable structure made from food-grade material with a size and shape corresponding to the overall shape of the food product and the largest size of the food product. The present invention is also designed to be quickly and easily folded into the storage configuration to retain the desired food products. In addition, the present invention includes an integrated mechanism that allows the user to reduce the storage space of the package box easily and quickly. For example, the integrated mechanism can be a cutaway section of material that can be torn by the user to remove a section of the package box, which reduces the overall storage space of the present invention. In addition, the present invention can include features that indicate the user from where the cutaway section can be torn from the package box. Furthermore, the present invention can be designed to enable the user to adjust the storage space of the package box before assembling the package box or after the package box has been assembled.

DETAILED DESCRIPTION OF THE INVENTION

All illustrations of the drawings are for the purpose of describing selected versions of the present invention and are not intended to limit the scope of the present invention.

Figure 1:
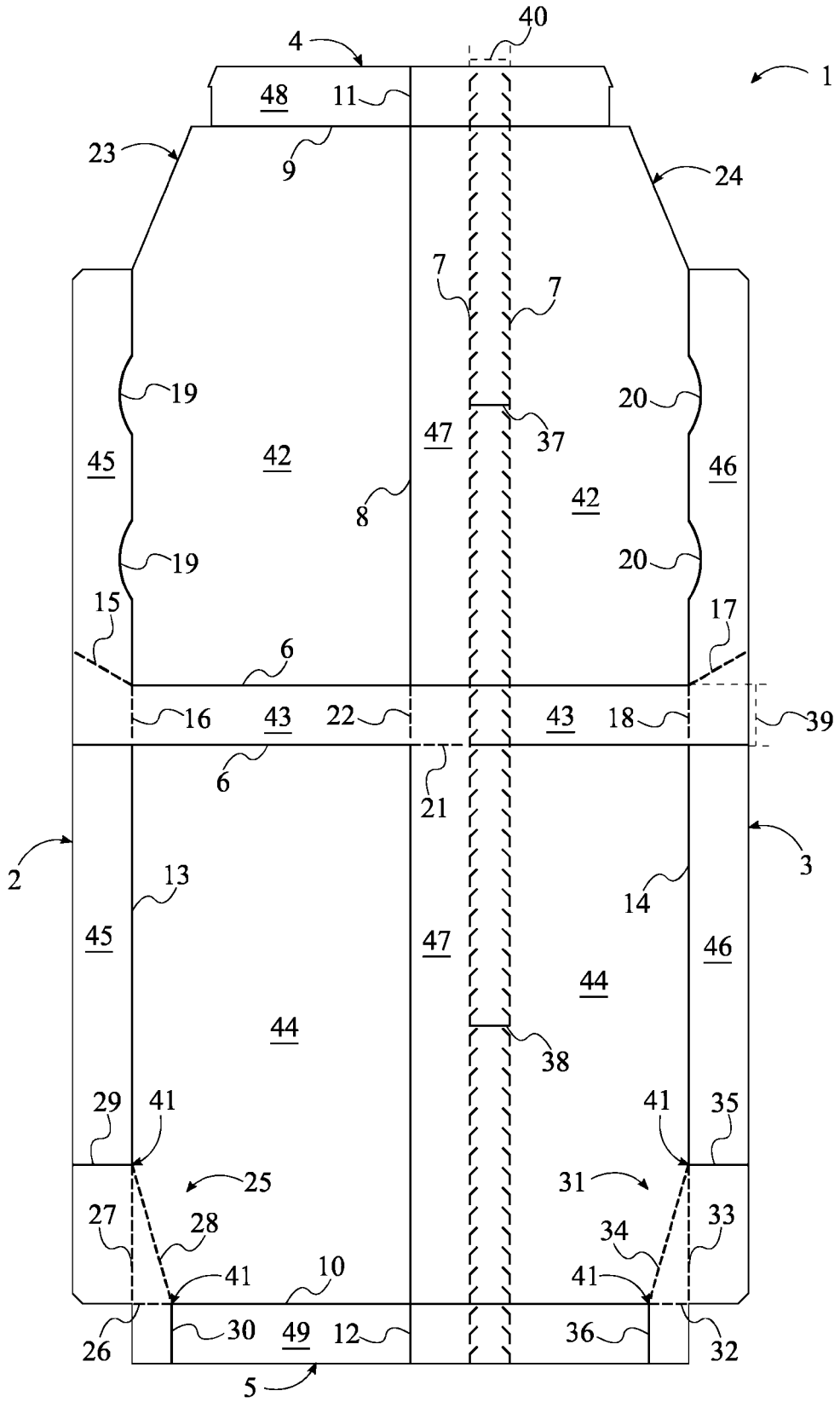
FIG. 1 is a front view of the present invention, wherein the present invention is shown in a flat configuration.
Figure 2:
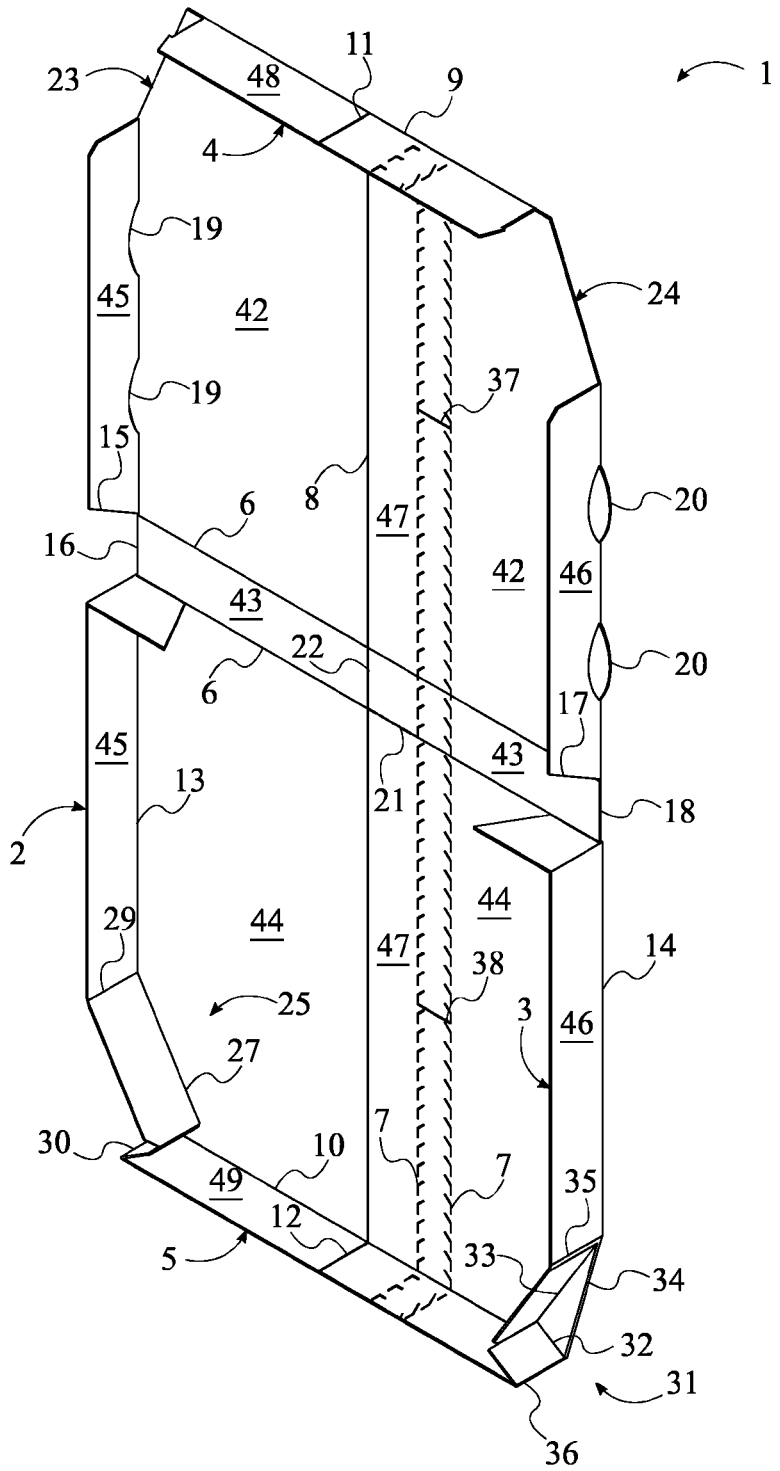
FIG. 2 is a top-front-left perspective view of the present invention, wherein the volume-adjustable package box is shown being assembled.
Figure 3:
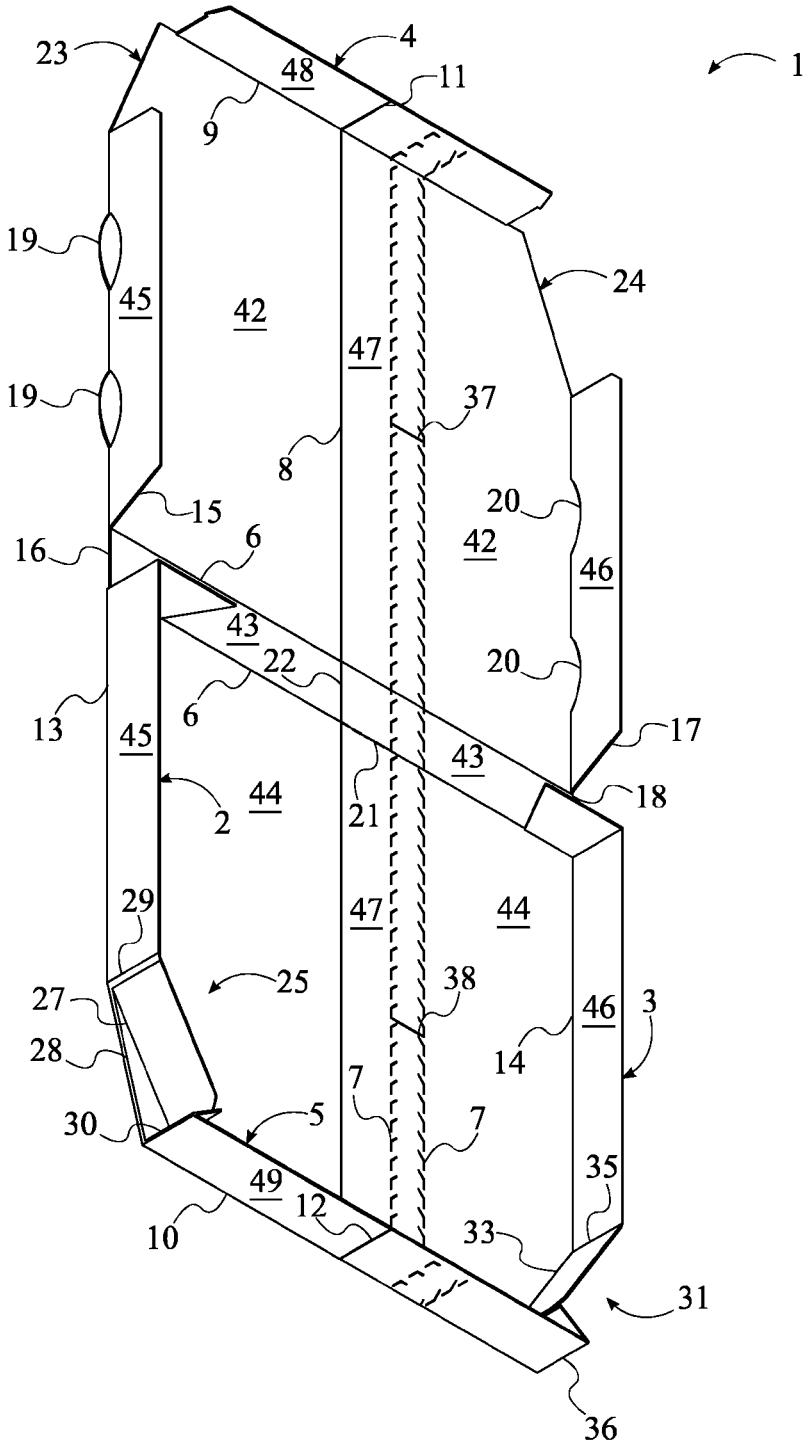
FIG. 3 is a bottom-front-right perspective view of the present invention, wherein the volume-adjustable package box is shown being assembled.
Figure 4:
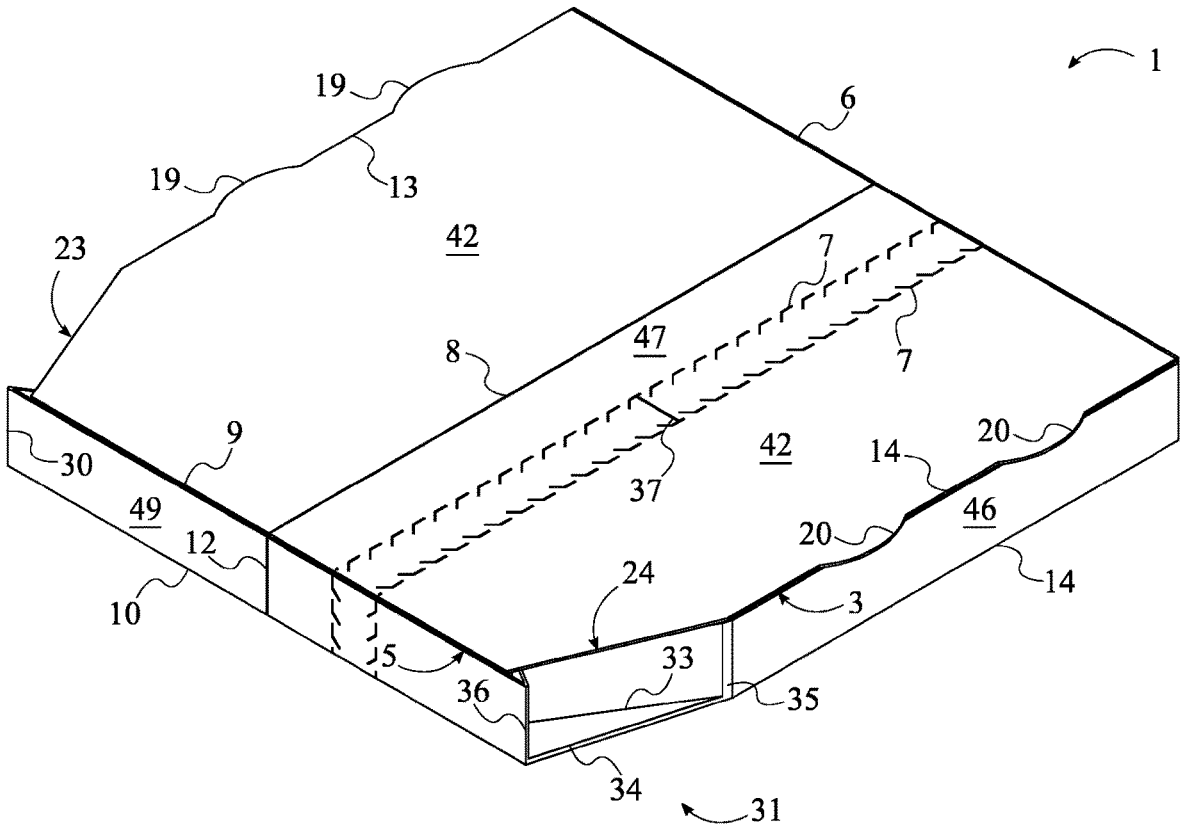
FIG. 4 is a top-front-left perspective view of the present invention, wherein the present invention is shown in a box configuration.
Figure 5:
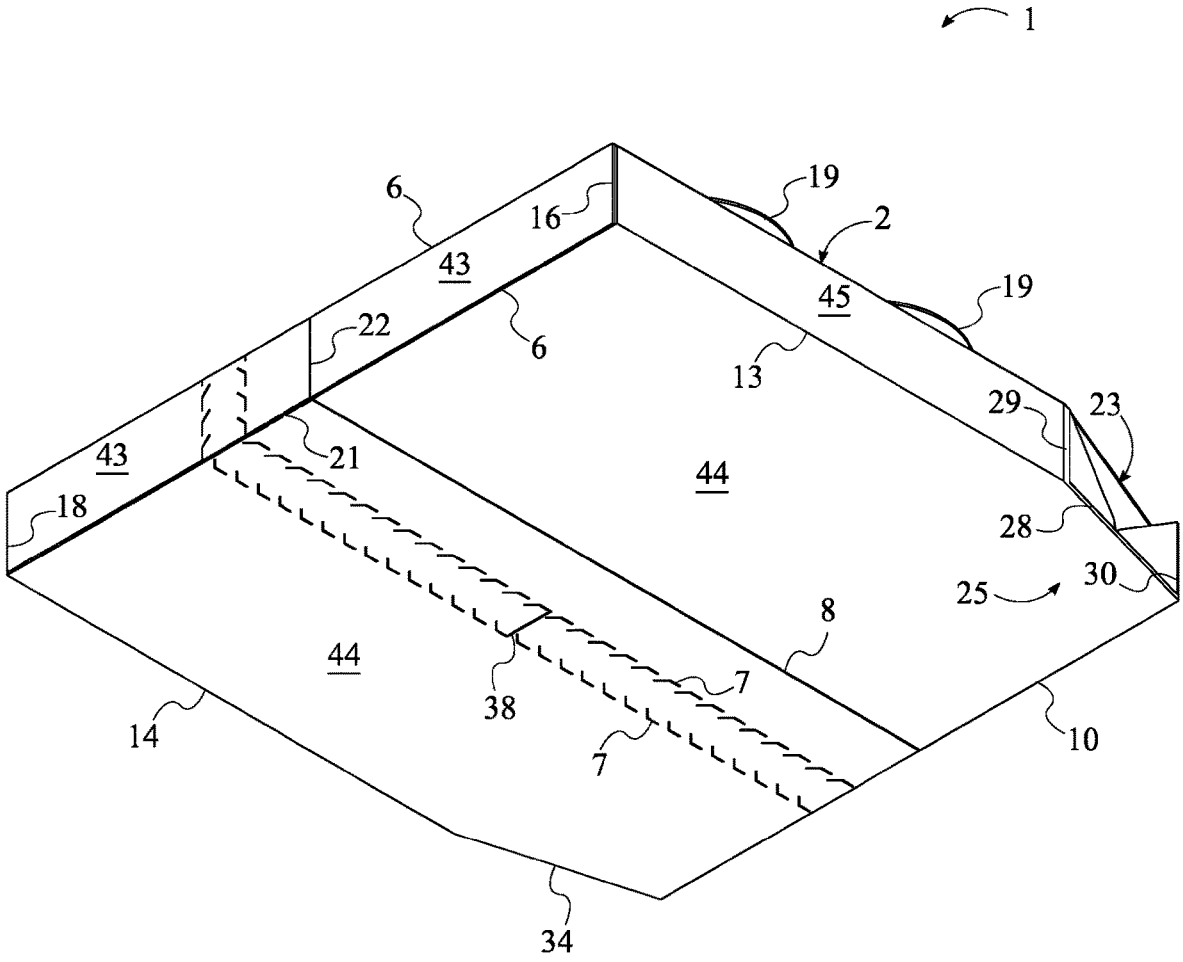
FIG. 5 is a bottom-rear-right perspective view of the box configuration of the present invention.
Figure 6:
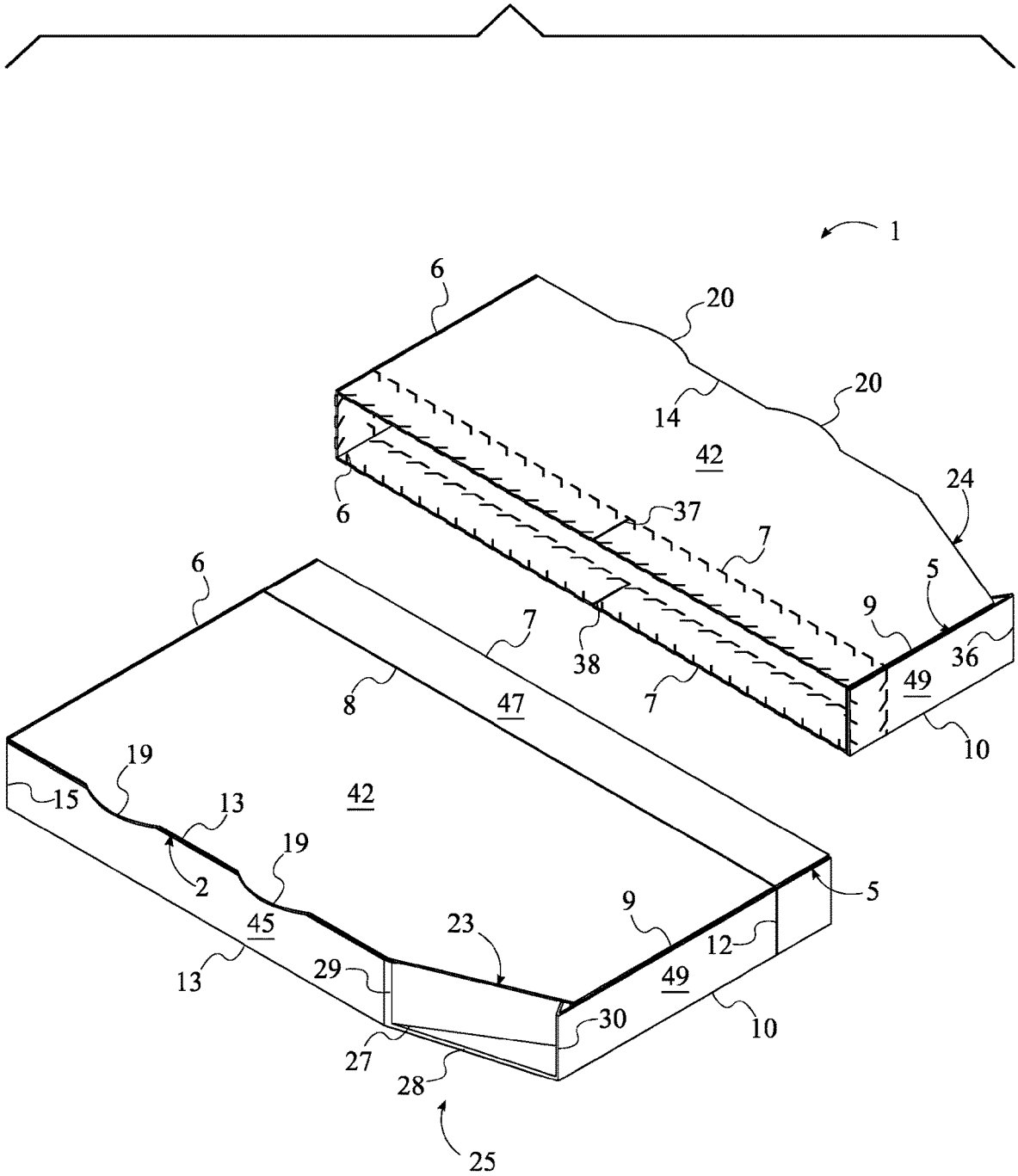
FIG. 6 is a top-front-right exploded perspective view of the box configuration of the present invention, wherein a section of the present invention is shown removed to reduce the size of the box configuration.
Figure 7:
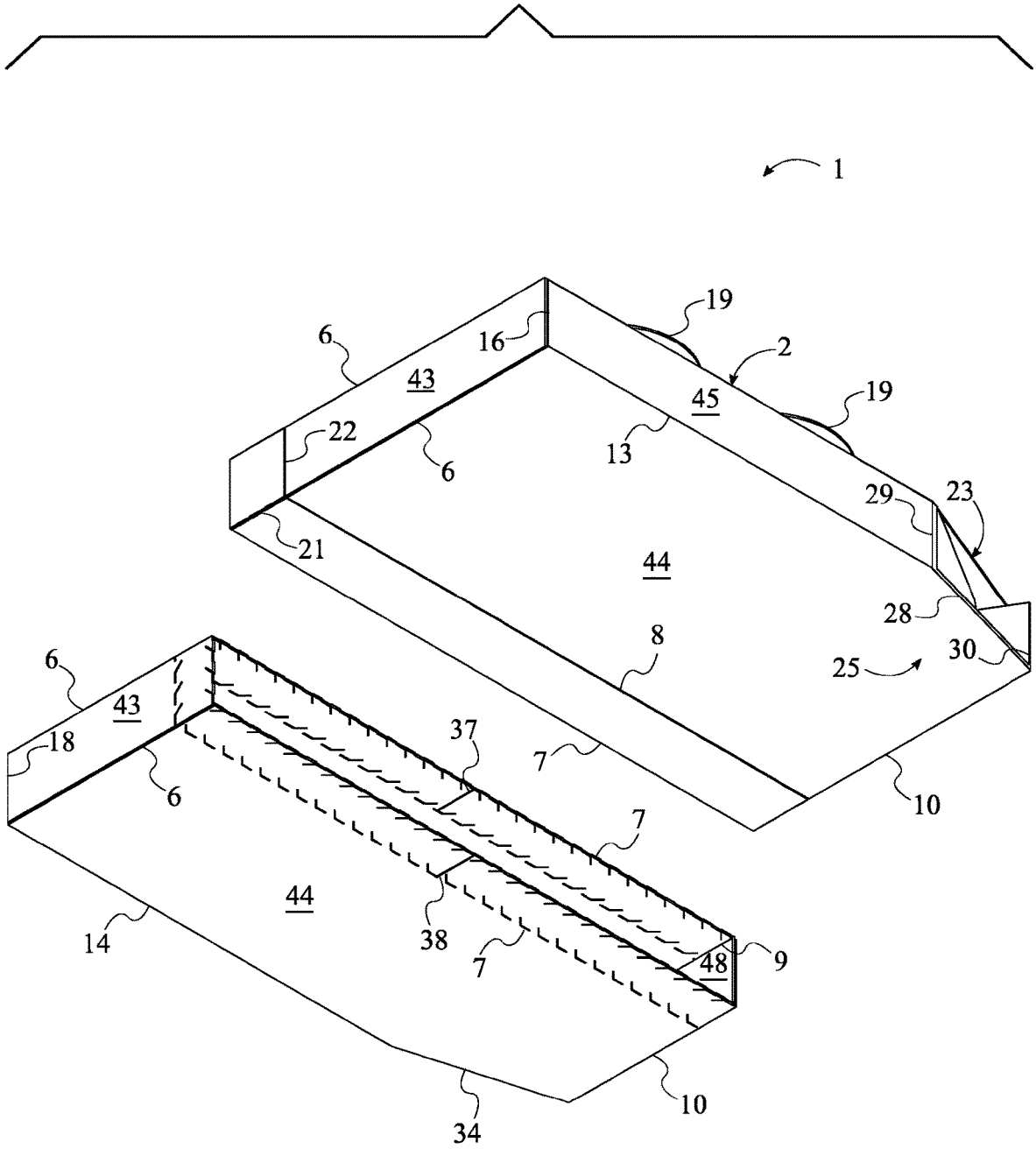
FIG. 7 is a bottom-rear-right exploded perspective view of the box configuration of the present invention, wherein a section of the present invention is shown removed to reduce the size of the box configuration.
Figure 8:
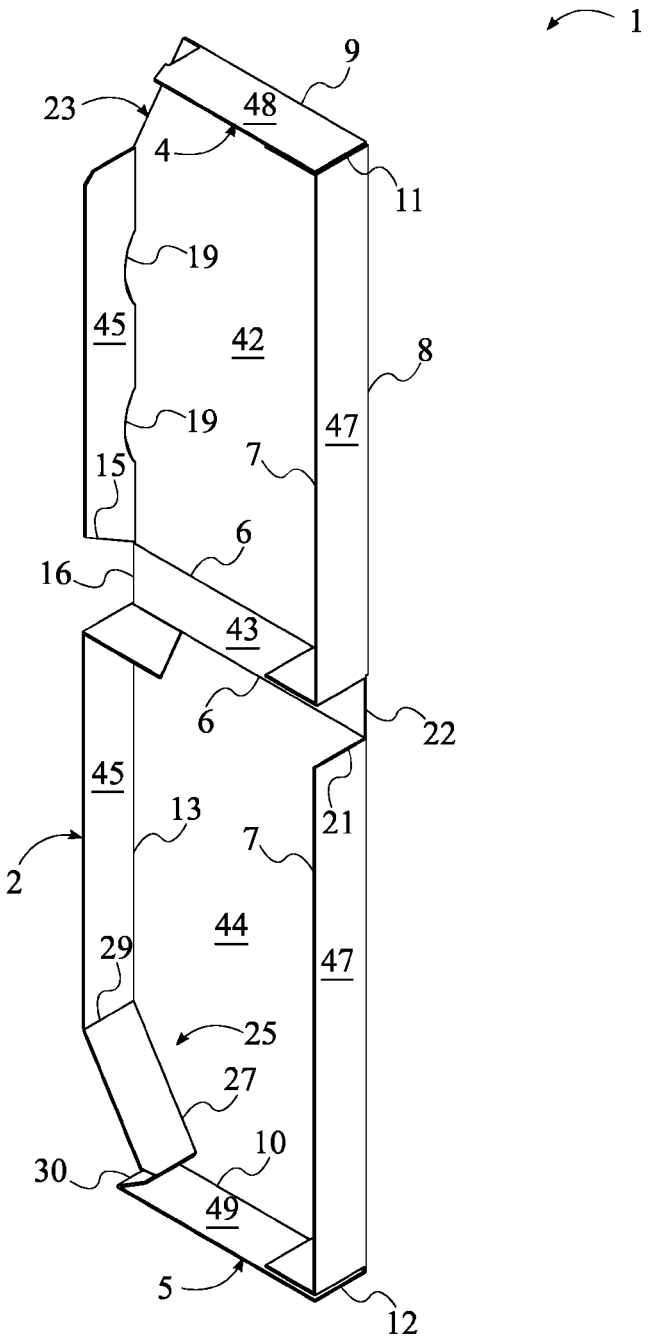
FIG. 8 is a top-front-left perspective view of the present invention, wherein the volume-adjustable package box is shown being assembled, and wherein a section of the present invention is shown removed.
Figure 9:
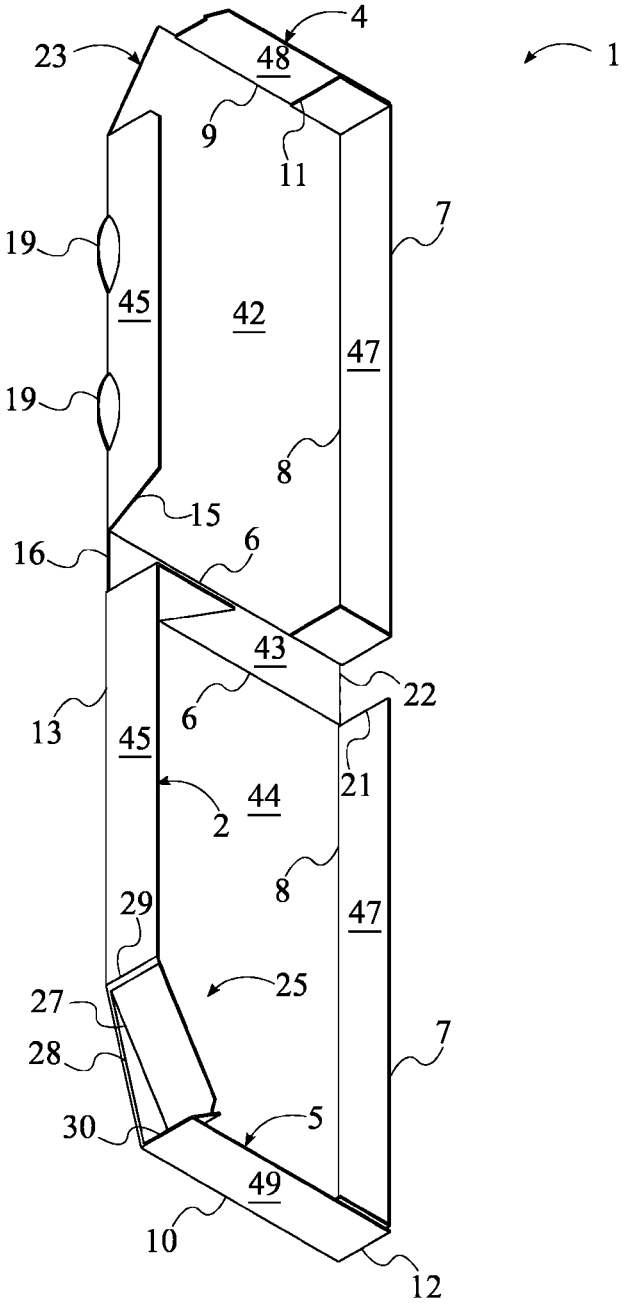
FIG. 9 is a bottom-front-right perspective view of the present invention, wherein the volume-adjustable package box is shown being assembled, and wherein a section of the present invention is shown removed.
Figure 10:
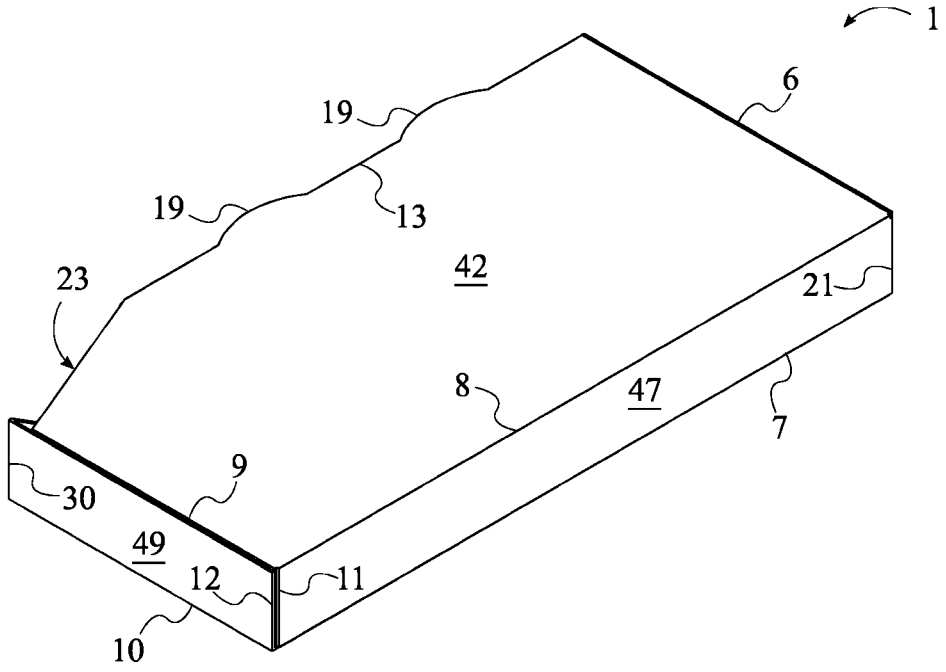
FIG. 10 is a top-front-left perspective view of the reduced box configuration of the present invention.
Figure 11:
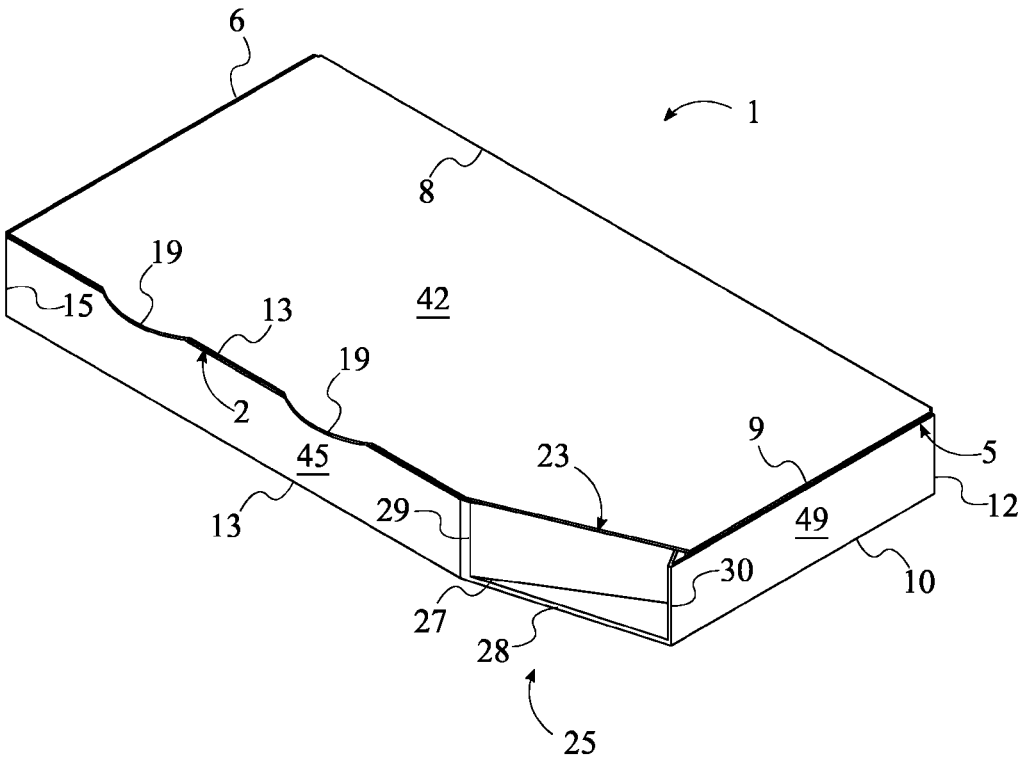
FIG. 11 is a top-front-right perspective view of the reduced box configuration of the present invention.

The present invention discloses a volume-adjustable package box. The volume-adjustable package box is designed with a storage space that can be easily reduced to retain a smaller amount of product. As can be seen in FIGS. 1 through 11, the present invention comprises a foldable piece of boxing material 1. The foldable piece of boxing material 1 is designed to be easily assembled to retain a large amount of products. The foldable piece of boxing material 1 is preferably made from food-grade material with an overall size and shape that accommodates a maximum amount of product. For example, the foldable piece of boxing material 1 can be designed to retain a full round pizza. In addition, the foldable piece of boxing material 1 includes integrated means that enable the removal of sections of the boxing material to form a smaller package box that retains a smaller amount of product, such as leftover slices of pizza.

As can be seen in FIGS. 1 through 11, the foldable piece of boxing material 1 can be manufactured in a flat configuration which can then be assembled into a box configuration that preferably retains a pizza. To enable the easy assembly of the present invention as well as to enable the quick removal of sections of boxing material, the foldable piece of boxing material 1 comprises a first lengthwise edge 2, a second lengthwise edge 3, a first widthwise edge 4, a second widthwise edge 5, a backing pair of folding lines 6, a cutaway pair of perforated lines 7, and a secondary lengthwise-tab-defining folding line 8. The first lengthwise edge 2, the second lengthwise edge 3, the first widthwise edge 4, and the second widthwise edge 5 preferably correspond to the edges that define the outer perimeter of the foldable piece of boxing material 1. The backing pair of folding lines 6 correspond to lines indicating the locations where the foldable piece of boxing material 1 can be folded to form the backing of the present invention in the box configuration. The cutaway pair of perforated lines 7 correspond to lines indicating the location where the user can remove sections of boxing material to reduce the overall storage space of the present invention in the box configuration. However, in some embodiments, the cutaway pair of perforated lines 7 can be provided as a single cutaway perforated line that can be used to separate the section of the foldable piece of boxing material 1. Further, the secondary lengthwise-tab-defining folding line 8 corresponds to the line guide that indicates the user where to fold the remaining section of boxing material to form a lengthwise tab that encloses the reduced box configuration of the present invention.

In the preferred embodiment, the present invention can be designed as follows. As can be seen in FIGS. 1 through 11, the backing pair of folding lines 6 are positioned parallel and offset from each other by a box height 39. The box height 39 preferably corresponds to the distance that separates the largest sections of the foldable piece of boxing material 1 when assembled into the box configuration. Further, the backing pair of folding lines 6 traverse perpendicular from the first lengthwise edge 2 to the second lengthwise edge 3. In addition, the backing pair of folding lines 6 are centrally positioned in between the first widthwise edge 4 and the second widthwise edge 5. This way, when the user is folding the foldable piece of boxing material 1 along the backing pair of folding lines 6, the foldable piece of boxing material 1 is divided into three large sections corresponding to a cover section 42, a backing section 43, and a base section 44 of the present invention in the box configuration. Further, the cutaway pair of perforated lines 7 traverse from the first widthwise edge 4 to the second widthwise edge 5 For example, the cutaway pair of perforated lines 7 can traverse perpendicular from the first widthwise edge 4 to the second widthwise edge 5, similar to the backing pair of folding lines 6. Alternatively, the cutaway pair of perforated lines 7 can traverse from the first widthwise edge 4 to the second widthwise edge 5 in a non-linear manner. For example, the cutaway pair of perforated lines 7 can traverse linearly across the cover section 42, turn at a specific angle across the backing section 43, and then traverse also linearly across the base section 44. Thus, the cutaway pair of perforated lines 7 would resemble an overall elongated Z-shape. In other embodiments, the cutaway pair of perforated lines 7 can be arranged into different patterns.

In addition, the cutaway pair of perforated lines 7 are positioned parallel and offset from each other by a ribbon width 40. The ribbon width 40 is preferably a distance between the cutaway pair of perforated lines 7 large enough to accommodate at least one finger digit. This allows the user to easily remove the section of foldable piece of boxing material 1 between the cutaway pair of perforated lines 7 using a finger or two. However, in embodiments where the cutaway pair of perforated lines 7 are provided as a single cutaway perforated line, the ribbon width 40 is not present on the foldable piece of boxing material 1. Further, the secondary lengthwise-tab-defining folding line 8 traverses perpendicular from the first widthwise edge 4 to the second widthwise edge 5, parallel to the first widthwise edge 4 and the second widthwise edge 5. In addition, the secondary lengthwise-tab-defining folding line 8 is positioned in between the first lengthwise edge 2 and the cutaway pair of perforated lines 7. This way, when the user tears the section of foldable piece of boxing material 1 between the cutaway pair of perforated lines 7, the user can utilize the secondary lengthwise-tab-defining folding line 8 to form a secondary lengthwise tab 47 to enclose the remaining section of the present invention in the reduced box configuration.

To enable the user to fully form the box structure in the box configuration of the present invention, the present invention can further include guide folding lines for the user to form widthwise lateral tabs that enclose the box configuration of the present invention. As can be seen in FIGS. 1 through 11, the foldable piece of boxing material 1 may further comprise a first primary widthwise-tab-defining folding line 9 and a second primary widthwise-tab-defining folding line 10. The first primary widthwise-tab-defining folding line 9 and the second primary widthwise-tab-defining folding line 10 enable the user to form a first widthwise tab 48 and a second widthwise tab 49 along the shorter edges of the foldable piece of boxing material 1 in the box configuration of the present invention. To do so, the first primary widthwise-tab-defining folding line 9 traverses perpendicular from the first lengthwise edge 2 to the second lengthwise edge 3. This enables the formation of the first widthwise tab 48 adjacent to the first widthwise edge 4 of the foldable piece of boxing material 1. In addition, the first primary widthwise-tab-defining folding line 9 is positioned offset from the first widthwise edge 4 by the box height 39 so that the first widthwise tab 48 matches the height of the backing section 43 of the foldable piece of boxing material 1 in the box configuration of the present invention. Similarly, the second primary widthwise-tab-defining folding line 10 traverses perpendicular from the first lengthwise edge 2 to the second lengthwise edge 3. This enables the formation of a second widthwise tab 49 adjacent to the second widthwise edge 5 of the foldable piece of boxing material 1. In addition, the second primary widthwise-tab-defining folding line 10 is positioned offset from the second widthwise edge 5 by the box height 39 so that the second widthwise tab 49 also matches the height of the backing section 43 of the foldable piece of boxing material 1 in the box configuration of the present invention.

To accommodate the secondary lengthwise tab 47 formed using the secondary lengthwise-tab-defining folding line 8, the foldable piece of boxing material 1 may further comprise a first primary widthwise-tab-dividing perforated line 11 and a second primary widthwise-tab-dividing perforated line 12. As can be seen in FIGS. 1 through 11, the first primary widthwise-tab-dividing perforated line 11 and the second primary widthwise-tab-dividing perforated line 12 enable the separation of the secondary lengthwise tab 47 from the first widthwise tab 48 and the second widthwise tab 49 when the box configuration of the present invention has been reduced in size to retain a smaller amount of product. So, the first primary widthwise-tab-dividing perforated line 11 and the second primary widthwise-tab-dividing perforated line 12 are positioned coincident to the secondary lengthwise-tab-defining folding line 8. This enables the portions of the secondary lengthwise tab 47 adjacent to the first widthwise tab 48 and the second widthwise tab 49 to be separated when enclosing the reduced box configuration of the present invention. In addition, the first primary widthwise-tab-dividing perforated line 11 traverses perpendicular from the first widthwise edge 4 to the first primary widthwise-tab-defining folding line 9 so that the torn portion of the secondary lengthwise tab 47 adjacent to the first widthwise tab 48 is square shaped. Similarly, the second primary widthwise-tab-dividing perforated line 12 traverses perpendicular from the second widthwise edge 5 to the second primary widthwise-tab-defining folding line 10 so that the torn portion of the secondary lengthwise tab 47 adjacent to the second widthwise tab 49 is also square shaped.

To further enable the user to fully form the box structure in the box configuration of the present invention, the present invention can further include guide folding lines for the user to form lengthwise lateral tabs that enclose the box configuration of the present invention. As can be seen in FIGS. 1 through 11, the foldable piece of boxing material 1 may further comprise a first primary lengthwise-tab-defining folding line 13 and a second primary lengthwise-tab-defining folding line 14. The first primary lengthwise-tab-defining folding line 13 and the second primary lengthwise-tab-defining folding line 14 enable the user to form a first lengthwise tab 45 and a second lengthwise tab 46 along the longer edges of the foldable piece of boxing material 1 in the box configuration of the present invention. To do so, the first primary lengthwise-tab-defining folding line 13 traverses perpendicular from the first widthwise edge 4 to the second widthwise edge 5. This enables the formation of the first lengthwise tab 45 adjacent to the first lengthwise edge 2 of the foldable piece of boxing material 1. In addition, the first primary lengthwise-tab-defining folding line 13 is positioned offset from the first lengthwise edge 2 by the box height 39 so that the first lengthwise tab 45 matches the height of the backing section 43 of the foldable piece of boxing material 1 in the box configuration of the present invention. Similarly, the second primary lengthwise-tab-defining folding line 14 traverses perpendicular from the first widthwise edge 4 to the second widthwise edge 5. This enables the formation of a second lengthwise tab 46 adjacent to the second lengthwise edge 3 of the foldable piece of boxing material 1. In addition, the second primary lengthwise-tab-defining folding line 14 is positioned offset from the second lengthwise edge 3 by the box height 39 so that the second lengthwise tab 46 also matches the height of the backing section 43 of the foldable piece of boxing material 1 in the box configuration of the present invention.

When the foldable piece of boxing material 1 is folded into the box configuration of the present invention, the first lengthwise tab 45 needs to be separated to enable the unobstructed folding of the cover section 42 towards the base section 44. As can be seen in FIGS. 1 through 11, the foldable piece of boxing material 1 may further comprise a first primary lengthwise-tab-dividing perforated line 15 and a first primary lengthwise-tab-separating perforated line 16. The first primary lengthwise-tab-dividing perforated line 15 enables the division of the first lengthwise tab 45 into two sections corresponding to the cover section 42 and the base section 44 of the foldable piece of boxing material 1. On the other hand, the first primary lengthwise-tab-separating perforated line 16 enables the separation of the first lengthwise tab 45 from the backing section 43 of the foldable piece of boxing material 1. To do so, the first primary lengthwise-tab-dividing perforated line 15 traverses from the first lengthwise edge 2 to the first primary lengthwise-tab-defining folding line 13 to help divide the first lengthwise tab 45 into two sections. Further, the first primary lengthwise-tab-separating perforated line 16 is positioned coincident with the first primary lengthwise-tab-defining folding line 13 so that the first lengthwise tab 45 can be separated along the first primary lengthwise-tab-defining folding line 13. In addition, the first primary lengthwise-tab-separating perforated line 16 traverses in between the cutaway pair of perforated lines 7 so that the first lengthwise tab 45 is separated from the backing section 43 of the foldable piece of boxing material 1. Furthermore, the first primary lengthwise-tab-dividing perforated line 15 terminally intersects the first primary lengthwise-tab-separating perforated line 16. This way, when the user is folding the foldable piece of boxing material 1 into the box configuration of the present invention, the formed first lengthwise tab 45 is divided into two sections along the first primary lengthwise-tab-dividing perforated line 15 and the section of the first lengthwise tab 45 adjacent to the backing section 43 is separated along the first primary lengthwise-tab-separating perforated line 16. The free end section of the first lengthwise tab 45 can then be folded inwards adjacent to the backing section 43 to help seal the box configuration of the present invention.

When the foldable piece of boxing material 1 is folded into the box configuration of the present invention, the second lengthwise tab 46 also needs to be separated to enable the unobstructed folding of the cover section 42 towards the base section 44. As can be seen in FIGS. 1 through 11, the foldable piece of boxing material 1 may further comprise a second primary lengthwise-tab-dividing perforated line 17 and a second primary lengthwise-tab-separating perforated line 18. The second primary lengthwise-tab-dividing perforated line 17 enables the division of the second lengthwise tab 46 into two sections corresponding to the cover section 42 and the base section 44 of the foldable piece of boxing material 1. On the other hand, the second primary lengthwise-tab-separating perforated line 18 enables the separation of the second lengthwise tab 46 from the backing section 43 of the foldable piece of boxing material 1. To do so, the second primary lengthwise-tab-dividing perforated line 17 traverses from the second lengthwise edge 3 to the second primary lengthwise-tab-defining folding line 14 to help divide the second lengthwise tab 46 into two sections. Further, the second primary lengthwise-tab-separating perforated line 18 is positioned coincident with the second primary lengthwise-tab-defining folding line 14 so that the second lengthwise tab 46 can be separated along the second primary lengthwise-tab-defining folding line 14. In addition, the second primary lengthwise-tab-separating perforated line 18 traverses in between the cutaway pair of perforated lines 7 so that the second lengthwise tab 46 is separated from the backing section 43 of the foldable piece of boxing material 1. Furthermore, the second primary lengthwise-tab-dividing perforated line 17 terminally intersects the second primary lengthwise-tab-separating perforated line 18. This way, when the user is folding the foldable piece of boxing material 1 into the box configuration of the present invention, the formed second lengthwise tab 46 is divided into two sections along the second primary lengthwise-tab-dividing perforated line 17 and the section of the second lengthwise tab 46 adjacent to the backing section 43 is separated along the second primary lengthwise-tab-separating perforated line 18. The free end section of the second lengthwise tab 46 can then be folded inwards adjacent to the backing section 43 to help seal the box configuration of the present invention.

In embodiments where the present invention is designed to retain hot products, like a freshly baked pizza, the present invention may include ventilation means that enables moisture to escape. As can be seen in FIGS. 1 through 11, the foldable piece of boxing material 1 may further comprise a plurality of first arc-shaped cuts 19 and a plurality of second arc-shaped cuts 20. The plurality of first arc-shaped cuts 19 and the plurality of second arc-shaped cuts 20 are designed to enable the formation of vents throughout the foldable piece of boxing material 1 in the box configuration of the present invention. To do so, the plurality of first arc-shaped cuts 19 is distributed along the first primary lengthwise-tab-defining folding line 13. This way, when the first lengthwise tab 45 is formed by folding the foldable piece of boxing material 1 along the first primary lengthwise-tab-defining folding line 13, several arc-shaped openings are formed. Similarly, the plurality of second arc-shaped cuts 20 is distributed along the second primary lengthwise-tab-defining folding line 14. This way, when the second lengthwise tab 46 is formed by folding the foldable piece of boxing material 1 along the second primary lengthwise-tab-defining folding line 14, several arc-shaped openings are also formed to enable moisture to escape.

When the reduced box configuration of the present invention is formed by removing the section of the foldable piece of boxing material 1 adjacent to the second lengthwise edge 3 using the cutaway pair of perforated lines 7, the secondary lengthwise tab 47 also needs to be separated to not obstruct the folding of the cover section 42 towards the base section 44. As can be seen in FIGS. 1 through 11, the foldable piece of boxing material 1 may further comprise a secondary lengthwise-tab-dividing perforated line 21 and a secondary lengthwise-tab-separating perforated line 22 that allows the secondary lengthwise tab 47 to be divided into two sections corresponding to the cover section 42 and the base section 44 of the foldable piece of boxing material 1. To do so, the secondary lengthwise-tab-dividing perforated line 21 traverses from the cutaway pair of perforated lines 7 to the secondary lengthwise-tab-defining folding line 8. This allows the secondary lengthwise tab 47 to be divided into two sections. Further, the secondary lengthwise-tab-separating perforated line 22 is positioned coincident with the secondary lengthwise-tab-defining folding line 8. In addition, the secondary lengthwise-tab-separating perforated line 22 traverses in between the cutaway pair of perforated lines 7. This way, the section of the secondary lengthwise tab 47 adjacent to the backing section 43 can be separated from the backing section 43. Furthermore, the secondary lengthwise-tab-dividing perforated line 21 terminally intersects the secondary lengthwise-tab-separating perforated line 22. This way, when the user is folding the foldable piece of boxing material 1 into the reduced box configuration of the present invention, the formed secondary lengthwise tab 47 is divided into two sections along the secondary lengthwise-tab-dividing perforated line 21 and the section of the secondary lengthwise tab 47 adjacent to the backing section 43 is separated along the secondary lengthwise-tab-separating perforated line 22. The free end section of the secondary lengthwise tab 47 can then be folded inwards adjacent to the backing section 43 to help seal the reduced box configuration of the present invention.

In some embodiments, in order to reduce boxing material, the corners of the foldable piece of boxing material 1 may be cut off to reduce the amount of boxing material needed to retain a desired amount of product. As can be seen in FIGS. 1 through 11, the foldable piece of boxing material 1 may further comprise a first corner cutout 23 and a second corner cutout 24. The first corner cutout 23 and the second corner cutout 24 allow for less material to be used in the present invention while still accommodating the desired amount of product inside the box configuration of the present invention. To do so, the first corner cutout 23 is integrated between the first lengthwise edge 2 and the first widthwise edge 4. Similarly, the second corner cutout 24 is integrated between the second lengthwise edge 3 and the first widthwise edge 4. This results in the cover section 42 of the foldable piece of boxing material 1 having an irregular hexagonal shape that matches the dimensions of the base section 44 of the foldable piece of boxing material 1. In other embodiments, additional cutouts can be included to further reduce the amount of boxing material needed to accommodate a desired maximum amount of product in the box configuration of the present invention.

In the embodiments where the cover section 42 of the foldable piece of boxing material 1 has an irregular hexagonal shape, the overall rectangular base section 44 can be designed to be folded to match the cover section 42 shape. As can be seen in FIGS. 1 through 11, the foldable piece of boxing material 1 may further comprise a first triangular-shaped folding pattern 25 that enables the corresponding corner of the base section 44 to be folded to match the shape of the first corner cutout 23 on the cover section 42 of the foldable piece of boxing material 1. The first triangular-shaped folding pattern 25 comprises a first short-side folding line 26, a first long-side folding line 27, and a first hypothenuse folding line 28 corresponding to the three sides of the first triangular-shaped folding pattern 25. To enable the folding of the corner of the base section 44 matching the position of the second corner cutout 24 of the foldable piece of boxing material 1, the first long-side folding line 27 is distributed along the first primary lengthwise-tab-defining folding line 13 adjacent to the second primary widthwise-tab-defining folding line 10. In addition, the first short-side folding line 26 is distributed along the second primary widthwise-tab-defining folding line 10 adjacent to the first primary lengthwise-tab-defining folding line 13. This way, the first long-side folding line 27 and the first short-side folding line 26 preferably form the right-angle vertex 41 of the first triangular-shaped folding pattern 25. Further, the first hypothenuse folding line 28 terminally intersects the first long-side folding line 27 offset from the first short-side folding line 26 to form the second vertex 41 of the first triangular-shaped folding pattern 25. Furthermore, the first hypothenuse folding line 28 terminally intersects the first short-side folding line 26 offset from the first long-side folding line 27 to form the third vertex 41 of the first triangular-shaped folding pattern 25. Then, the user can fold the section of the foldable piece of boxing material 1 within the first triangular-shaped folding pattern 25 inwards. This positions the section of the first lengthwise tab 45 adjacent to the first long-side folding line 27 inwards at an angle matching the first corner cutout 23 of the cover section 42 of the foldable piece of boxing material 1. This also positions the section of the second widthwise tab 49 adjacent to the first short-side folding line 26 inwards. Thus, the corner of the base section 44 of the foldable piece of boxing material 1 that matches the position of the first corner cutout 23 in the box configuration of the present invention can be folded to match the shape.

To help facilitate the folding of the corner of the base section 44 of the foldable piece of boxing material 1 that matches the position of the first corner cutout 23 in the box configuration of the present invention, the first triangular-shaped folding pattern 25 may further comprise a first primary lengthwise-tab-interfacing folding line 29 and a first primary widthwise-tab-interfacing folding line 30. As can be seen in FIG. 1 through 11, the first primary lengthwise-tab-interfacing folding line 29 facilitates the inward folding of the section of the first lengthwise tab 45 adjacent to the first long-side folding line 27. The first primary widthwise-tab-interfacing folding line 30 facilitates the inward folding of the section of the second widthwise tab 49 adjacent to the first short-side folding line 26. To do so, the first primary lengthwise-tab-interfacing folding line 29 traverses perpendicular from the first primary lengthwise-tab-defining folding line 13 to the first lengthwise edge 2. In addition, the vertex 41 between the first long-side folding line 27 and the first hypothenuse folding line 28 terminally intersects the first primary lengthwise-tab-interfacing folding line 29 to guide the inward folding of the section of the first lengthwise tab 45 adjacent to the first long-side folding line 27. Further, the first primary widthwise-tab-interfacing folding line 30 traverses perpendicular from the first primary widthwise-tab-defining folding line 9 to the second widthwise edge 5. In addition, the vertex 41 between the first short-side folding line 26 and the first hypothenuse folding line 28 terminally intersects the first primary widthwise-tab-interfacing folding line 30 to guide the inward folding of the section of the second widthwise tab 49 adjacent to the first short-side folding line 26.

As can be seen in FIGS. 1 through 11, the foldable piece of boxing material 1 may further comprise a second triangular-shaped folding pattern 31 that enables the corresponding corner of the base section 44 to be folded to match the shape of the second corner cutout 24 on the cover section 42 of the foldable piece of boxing material 1. The second triangular-shaped folding pattern 31 comprises a second short-side folding line 32, a second long-side folding line 33, and a second hypothenuse folding line 34 corresponding to the three sides of the second triangular-shaped folding pattern 31. To enable the folding of the corner of the base section 44 matching the position of the second corner cutout 24 of the foldable piece of boxing material 1, the second long-side folding line 33 is distributed along the second primary lengthwise-tab-defining folding line 14 adjacent to the second primary widthwise-tab-defining folding line 10. In addition, the second short-side folding line 32 is distributed along the second primary widthwise-tab-defining folding line 10 adjacent to the second primary lengthwise-tab-defining folding line 14. This way, the second long-side folding line 33 and the second short-side folding line 32 preferably form the right-angle vertex 41 of the second triangular-shaped folding pattern 31. Further, the second hypothenuse folding line 34 terminally intersects the second long-side folding line 33 offset from the second short-side folding line 32 to form the second vertex 41 of the second triangular-shaped folding pattern 31. Furthermore, the second hypothenuse folding line 34 terminally intersects the second short-side folding line 32 offset from the second long-side folding line 33 to form the third vertex 41 of the second triangular-shaped folding pattern 31. Then, the user can fold the section of the foldable piece of boxing material 1 within the second triangular-shaped folding pattern 31 inwards. This positions the section of the second lengthwise tab 46 adjacent to the second long-side folding line 33 inwards at an angle matching the second corner cutout 24 of the cover section 42 of the foldable piece of boxing material 1. This also positions the section of the second widthwise tab 49 adjacent to the second short-side folding line 32 inwards. Thus, the corner of the base section 44 of the foldable piece of boxing material 1 that matches the position of the second corner cutout 24 in the box configuration of the present invention can be folded to match the shape.

To help facilitate the folding of the corner of the base section 44 of the foldable piece of boxing material 1 that matches the position of the second corner cutout 24 in the box configuration of the present invention, the second triangular-shaped folding pattern 31 may further comprise a second primary lengthwise-tab-interfacing folding line 35 and a second primary widthwise-tab-interfacing folding line 36. As can be seen in FIGS. 1 through 11, the second primary lengthwise-tab-interfacing folding line 35 facilitates the inward folding of the section of the second lengthwise tab 46 adjacent to the second long-side folding line 33. The second primary widthwise-tab-interfacing folding line 36 facilitates the inward folding of the section of the second widthwise tab 49 adjacent to the second short-side folding line 32. To do so, the second primary lengthwise-tab-interfacing folding line 35 traverses perpendicular from the second primary lengthwise-tab-defining folding line 14 to the second lengthwise edge 3. In addition, the vertex 41 between the second long-side folding line 33 and the second hypothenuse folding line 34 terminally intersects the second primary lengthwise-tab-interfacing folding line 35 to guide the inward folding of the section of the second lengthwise tab 46 adjacent to the second long-side folding line 33. Further, the second primary widthwise-tab-interfacing folding line 36 traverses perpendicular from the second primary widthwise-tab-defining folding line 10 to the second widthwise edge 5. In addition, the vertex 41 between the second short-side folding line 32 and the second hypothenuse folding line 34 terminally intersects the second primary widthwise-tab-interfacing folding line 36 to guide the inward folding of the section of the second widthwise tab 49 adjacent to the second short-side folding line 32.

In the flat configuration of the present invention, the cutaway pair of perforated lines 7 can be torn away from the ends adjacent to the first widthwise edge 4 or the second widthwise edge 5. This way, the user can reduce the size of the foldable piece of boxing material 1 to form a reduced box configuration of the present invention. However, the present invention also enables the user to remove the section of the foldable piece of boxing material 1 adjacent to the second lengthwise edge 3 using the cutaway pair of perforated lines 7 during the box configuration of the present invention. As can be seen in FIGS. 1 through 11, the foldable piece of boxing material 1 may further comprise a first tear-starting feature 37 that enables the user to tear off the section of foldable piece of boxing material 1 between the cutaway pair of perforated lines 7 in the box configuration of the present invention. The first tear-starting feature 37 can be a line cut that enables the user to insert a finger through and tear off the section of foldable piece of boxing material 1 between the cutaway pair of perforated lines 7. However, other starting features such as a tab or a hole large enough to accommodate a finger can be utilized. The first tear-starting feature 37 is positioned in between the cutaway pair of perforated lines 7 so that the user can grab the section of foldable piece of boxing material 1 in between the cutaway pair of perforated lines 7. In addition, the first tear-starting feature 37 is positioned in between the first widthwise edge 4 and the backing pair of folding lines 6. This way, the user can reduce the size of the present invention from the cover section 42 of the foldable piece of boxing material 1 in the box configuration. In embodiments where the cutaway pair of perforated lines 7 are provided as a single cutaway perforated line, the first tear-starting feature 37 can be provided along the single cutaway perforated line to enable the user to easily separate the sections of foldable piece of boxing material 1 from each other.

In some embodiments, the present invention can also enable the user to tear off the section of the foldable piece of boxing material 1 in between the cutaway pair of perforated lines 7 on the base section 44 of the foldable piece of boxing material 1. As can be seen in FIGS. 1 through 11, the foldable piece of boxing material 1 may further comprise a second tear-starting feature 38 that enables the user to tear off the section of foldable piece of boxing material 1 between the cutaway pair of perforated lines 7 in the box configuration of the present invention. The second tear-starting feature 38 can be a line cut that enables the user to insert a finger through and tear off the section of foldable piece of boxing material 1 between the cutaway pair of perforated lines 7. However, other starting features such as a tab or a hole large enough to accommodate a finger can be utilized. The second tear-starting feature 38 is positioned in between the cutaway pair of perforated lines 7 so that the user can grab the section of foldable piece of boxing material 1 in between the cutaway pair of perforated lines 7. In addition, the second tear-starting feature 38 is positioned in between the second widthwise edge 5 and the backing pair of folding lines 6. This way, the user can reduce the size of the present invention from the base section 44 of the foldable piece of boxing material 1 in the box configuration. In embodiments where the cutaway pair of perforated lines 7 are provided as a single cutaway perforated line, the second tear-starting feature 38 can be provided along the single cutaway perforated line to enable the user to easily separate the sections of foldable piece of boxing material 1 from each other.

Figure 12:
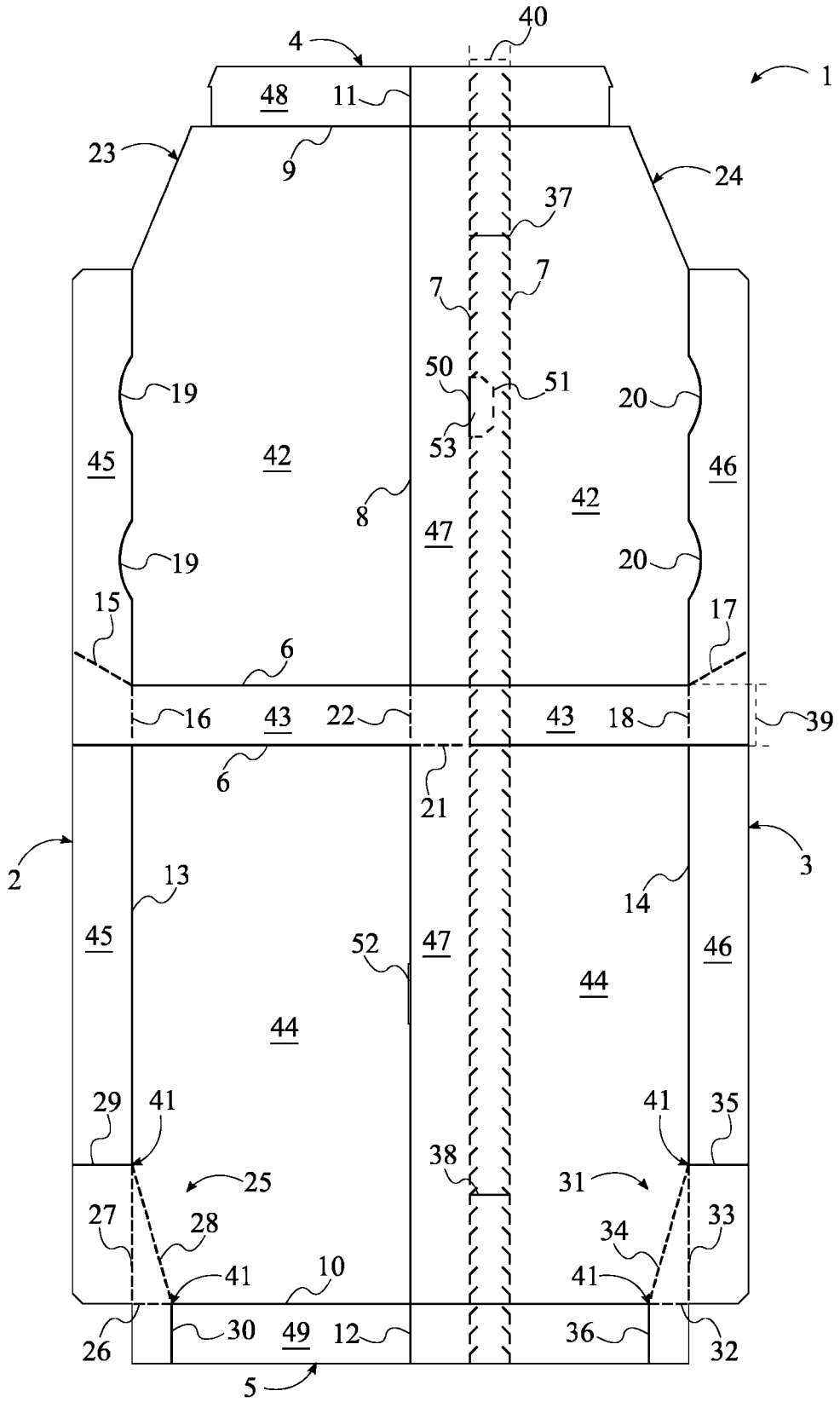
FIG. 12 is a front view of an alternate embodiment present invention, wherein the present invention is shown with an interlocking feature, and wherein the present invention is shown in a flat configuration.
Figure 13:
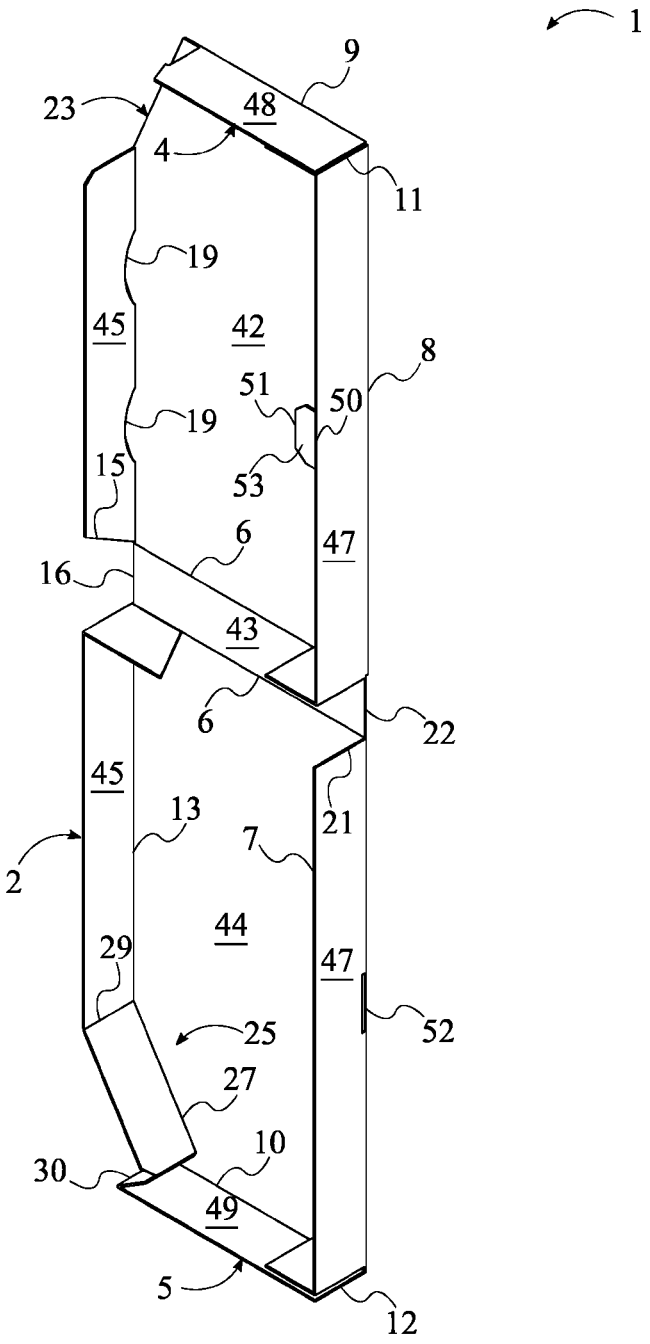
FIG. 13 is a top-front-left perspective view of the alternate embodiment of the present invention, wherein the volume-adjustable package box is shown being assembled, and wherein a section of the present invention is shown removed.
Figure 14:
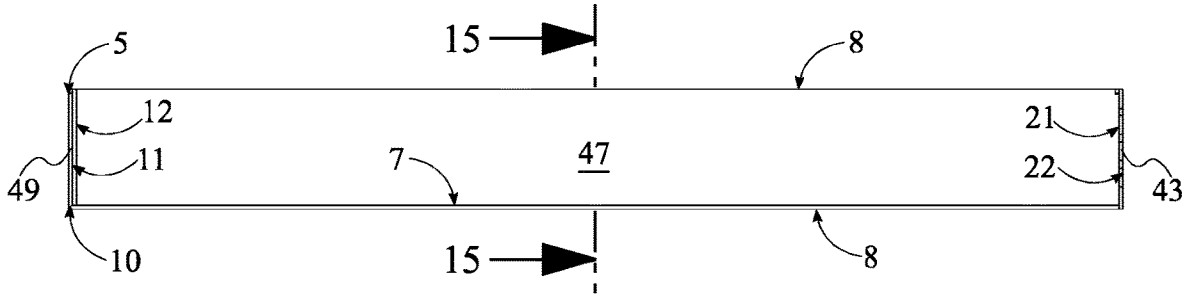
FIG. 14 is a side view of the reduced box configuration of the alternate embodiment of the present invention.
Figure 15:
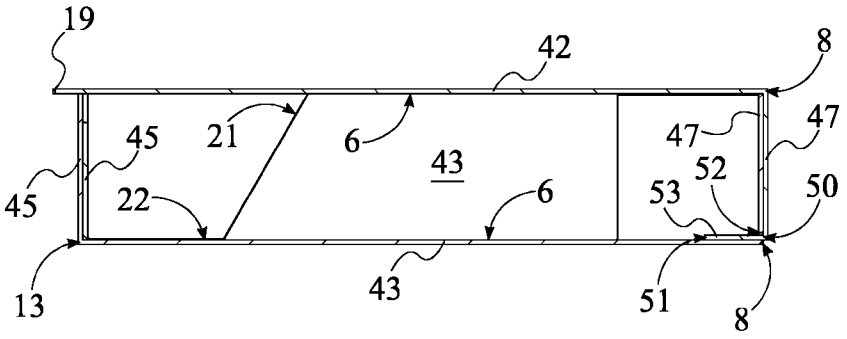
FIG. 15 is a vertical cross-sectional view of the alternate embodiment of the present invention taken along line 15-15 in FIG. 14.

In an alternate embodiment, the present invention may include an interlocking feature that enables the reduce box configuration of the present invention to be securely closed. As can be seen in FIGS. 12 through 15, the interlocking feature of the present invention enables the formed secondary lengthwise tab 47 to be securely sealed to prevent the secondary lengthwise tab 47 from accidentally disengaging when the reduce box configuration of the present invention is sealed. To do so, the foldable piece of boxing material 1 may further comprise at least one lip-defining folding line 50, at least one lip-separating perforated line 51, and at least one lip-receiving cut 52. The at least one lip-defining folding line 50 enables the creation of a lip 53 that can be interlocked with the at least one lip-receiving cut 52. The at least one lip-separating perforated line 51 enables the separation of the section of the foldable piece of boxing material 1 corresponding to the lip 53 from the section of the foldable piece of boxing material 1 between the cutaway pair of perforated lines 7. Accordingly, the at least one lip-defining folding line 50 is positioned coincident with the cutaway perforated line 7 adjacent to the secondary lengthwise-tab-defining folding line 8. The at least one lip-defining folding line 50 is also positioned in between the first primary widthwise-tab-defining folding line 9 and the backing pair of folding lines 7 so that the lip 53 can be centered on the cover section 42 of the foldable piece of boxing material 1. In addition, the at least one lip-separating perforated line 51 is positioned adjacent to the at least one lip-defining folding line 50. The at least one lip-separating perforated line 51 is also positioned in between the cutaway pair of perforated lines 7. This way, when the cutaway pair of perforated lines 7 are torn off the foldable piece of boxing material 1, the lip 53 is left attached to the secondary lengthwise-tab-defining folding line 8.

Furthermore, the at least one lip-receiving cut 52 is positioned coincident with the secondary lengthwise-tab-defining folding line 8 to match the orientation of the lip 53. The at least one lip-receiving cut 52 is also positioned in between the backing pair of folding lines 7 and the second primary widthwise-tab-defining folding line 10 so that the at least one lip-receiving cut 52 can be centered on the base section 44 of the foldable piece of boxing material 1. This way, the at least one lip-receiving cut 52 can match the location of the lip 53 in the reduced box configuration of the present invention. Thus, once the portion of the foldable piece of boxing material 1 adjacent to the second primary lengthwise-tab-defining folding line 14 is removed using the cutaway pair of perforated lines 7, the lip 53 can be formed using the at least one lip-defining folding line 50. Then, the secondary lengthwise tab 47 is formed using the secondary lengthwise-tab-defining folding line 8. The lip 53 is left protruding inwards so that the lip 53 can be inserted through the at least one lip-receiving cut 52. Then, after the cover section 42 is folded against the base section 44, the lip 53 is inserted through the at least one lip-receiving cut 52. Thus, the portions of the secondary lengthwise tab 47 corresponding to the cover section 42 and the base section 44 can be secured to each other in the reduced box configuration of the present invention. In other embodiments, additional lips 53 can be provided to further secure the reduced box configuration of the present invention. Alternatively, different interlocking features can be provided that help secure the reduced box configuration of the present invention.

Although the invention has been explained in relation to its preferred embodiment, it is to be understood that many other possible modifications and variations can be made without departing from the spirit and scope of the invention.

What is claimed is:

1. A volume-adjustable package box comprising:

a foldable piece of boxing material;

the foldable piece of boxing material comprising a first lengthwise edge, a second lengthwise edge, a first widthwise edge, a second widthwise edge, a backing pair of folding lines, a cutaway pair of perforated lines, a secondary lengthwise-tab-defining folding line, a first primary widthwise-tab-defining folding line, a second primary widthwise-tab-defining folding line, at least one lip-defining folding line, at least one lip-separating perforated line, and at least one lip-receiving cut;

the backing pair of folding lines being positioned parallel and offset from each other by a box height;

the backing pair of folding lines traversing from the first lengthwise edge to the second lengthwise edge;

the backing pair of folding lines being centrally positioned in between the first widthwise edge and the second widthwise edge;

the cutaway pair of perforated lines traversing perpendicular from the first widthwise edge to the second widthwise edge;

the cutaway pair of perforated lines being positioned parallel and offset from each other by a ribbon width;

the secondary lengthwise-tab-defining folding line traversing perpendicular from the first widthwise edge to the second widthwise edge;

the secondary lengthwise-tab-defining folding line being positioned in between the first lengthwise edge and the cutaway pair of perforated lines;

the first primary widthwise-tab-defining folding line traversing perpendicular from the first lengthwise edge to the second lengthwise edge;

the first primary widthwise-tab-defining folding line being positioned offset from the first widthwise edge by the box height;

the second primary widthwise-tab-defining folding line traversing perpendicular from the first lengthwise edge to the second lengthwise edge;

the second primary widthwise-tab-defining folding line being positioned offset from the second widthwise edge by the box height;

the at least one lip-defining folding line being positioned coincident with a proximal cutaway perforated line from the cutaway pair of perforated lines adjacent to the secondary lengthwise-tab-defining folding line;

the at least one lip-defining folding line being positioned in between the first primary widthwise-tab-defining folding line and the backing pair of folding lines;

the at least one lip-separating perforated line being positioned adjacent to the at least one lip-defining folding line;

the at least one lip-separating perforated line being positioned in between the cutaway pair of perforated lines;

the at least one lip-receiving cut being positioned coincident with the secondary lengthwise-tab-defining folding line; and the at least one lip-receiving cut being positioned in between the backing pair of folding lines and the second primary widthwise-tab-defining folding line.

2. The volume-adjustable package box as claimed in claim 1 comprising:

the foldable piece of boxing material further comprising a first primary widthwise-tab-dividing perforated line and a second primary widthwise-tab-dividing perforated line;

the first primary widthwise-tab-dividing perforated line and the second primary widthwise-tab-dividing perforated line being positioned coincident to the secondary lengthwise-tab-defining folding line;

the first primary widthwise-tab-dividing perforated line traversing perpendicular from the first widthwise edge to the first primary widthwise-tab-defining folding line; and the second primary widthwise-tab-dividing perforated line traversing perpendicular from the second widthwise edge to the second primary widthwise-tab-defining folding line.

3. The volume-adjustable package box as claimed in claim 1 comprising:

the foldable piece of boxing material further comprising a first primary lengthwise-tab-defining folding line and a second primary lengthwise-tab-defining folding line;

the first primary lengthwise-tab-defining folding line traversing perpendicular from the first widthwise edge to the second widthwise edge;

the first primary lengthwise-tab-defining folding line being positioned offset from the first lengthwise edge by the box height;

the second primary lengthwise-tab-defining folding line traversing perpendicular from the first widthwise edge to the second widthwise edge; and the second primary lengthwise-tab-defining folding line being positioned offset from the second lengthwise edge by the box height.

4. The volume-adjustable package box as claimed in claim 3 comprising:

the foldable piece of boxing material further comprising a first primary lengthwise-tab-dividing perforated line and a first primary lengthwise-tab-separating perforated line;

the first primary lengthwise-tab-dividing perforated line traversing from the first lengthwise edge to the first primary lengthwise-tab-defining folding line;

the first primary lengthwise-tab-separating perforated line being positioned coincident with the first primary lengthwise-tab-defining folding line;

the first primary lengthwise-tab-separating perforated line traversing in between the backing pair of folding lines; and the first primary lengthwise-tab-dividing perforated line terminally intersecting the first primary lengthwise-tab-separating perforated line.

5. The volume-adjustable package box as claimed in claim 3 comprising:

the foldable piece of boxing material further comprising a second primary lengthwise-tab-dividing perforated line and a second primary lengthwise-tab-separating perforated line;

the second primary lengthwise-tab-dividing perforated line traversing from the second primary lengthwise edge to the second primary lengthwise-tab-defining folding line;

the second primary lengthwise-tab-separating perforated line being positioned coincident with the second primary lengthwise-tab-defining folding line;

the second primary lengthwise-tab-separating perforated line traversing in between the backing pair of folding lines; and the second primary lengthwise-tab-dividing perforated line terminally intersecting the second primary lengthwise-tab-separating perforated line.

6. The volume-adjustable package box as claimed in claim 3 comprising:

the foldable piece of boxing material further comprising a plurality of first arc-shaped cuts and a plurality of second arc-shaped cuts;

the plurality of first arc-shaped cuts being distributed along the first primary lengthwise-tab-defining folding line; and the plurality of second arc-shaped cuts being distributed along the second primary lengthwise-tab-defining folding line.

7. The volume-adjustable package box as claimed in claim 1 comprising:

the foldable piece of boxing material further comprising a secondary lengthwise-tab-dividing perforated line and a secondary lengthwise-tab-separating perforated line;

the secondary lengthwise-tab-dividing perforated line traversing from the cutaway pair of perforated lines to the secondary lengthwise-tab-defining folding line;

the secondary lengthwise-tab-separating perforated line being positioned coincident with the secondary lengthwise-tab-defining folding line;

the secondary lengthwise-tab-separating perforated line traversing in between the backing pair of folding lines; and the secondary lengthwise-tab-dividing perforated line terminally intersecting the secondary lengthwise-tab-separating perforated line.

8. The volume-adjustable package box as claimed in claim 1 comprising:

the foldable piece of boxing material further comprising a first corner cutout and a second corner cutout;

the first corner cutout being integrated between the first lengthwise edge and the first widthwise edge; and the second corner cutout being integrated between the second lengthwise edge and the first widthwise edge.

9. The volume-adjustable package box as claimed in claim 1 comprising:

the foldable piece of boxing material further comprising a second primary widthwise-tab-defining folding line, a first primary lengthwise-tab-defining folding line, and a first triangular-shaped folding pattern;

the first triangular-shaped folding pattern comprising a first short-side folding line, a first long-side folding line, and a first hypothenuse folding line;

the second primary widthwise-tab-defining folding line traversing perpendicular from the first lengthwise edge to the second lengthwise edge;

the second primary widthwise-tab-defining folding line being positioned offset from the second widthwise edge by the box height;

the first primary lengthwise-tab-defining folding line traversing perpendicular from the first widthwise edge to the second widthwise edge;

the first primary lengthwise-tab-defining folding line being positioned offset from the first lengthwise edge by the box height;

the first long-side folding line being distributed along the first primary lengthwise-tab-defining folding line adjacent to the second primary widthwise-tab-defining folding line;

the first short-side folding line being distributed along the second primary widthwise-tab-defining folding line adjacent to the first primary lengthwise-tab-defining folding line;

the first hypothenuse folding line terminally intersecting the first long-side folding line offset from the first short-side folding line; and the first hypothenuse folding line terminally intersecting the first short-side folding line offset from the first long-side folding line.

10. The volume-adjustable package box as claimed in claim 9 comprising:

the first triangular-shaped folding pattern further comprising a first primary lengthwise-tab-interfacing folding line and a first primary widthwise-tab-interfacing folding line;

the first primary lengthwise-tab-interfacing folding line traversing perpendicular from the first primary lengthwise-tab-defining folding line to the first lengthwise edge;

a vertex between the first long-side folding line and the first hypothenuse folding line terminally intersecting the first primary lengthwise-tab-interfacing folding line;

the first primary widthwise-tab-interfacing folding line traversing perpendicular from the first primary widthwise-tab-defining folding line to the second widthwise edge; and a vertex between the first short-side folding line and the first hypothenuse folding line terminally intersecting the first primary widthwise-tab-interfacing folding line.

11. The volume-adjustable package box as claimed in claim 1 comprising:

the foldable piece of boxing material further comprising a second primary widthwise-tab-defining folding line, a second primary lengthwise-tab-defining folding line, and a second triangular-shaped folding pattern;

the second triangular-shaped folding pattern comprising a second short-side folding line, a second long-side folding line, and a second hypothenuse folding line;

the second primary widthwise-tab-defining folding line traversing perpendicular from the first lengthwise edge to the second lengthwise edge;

the second primary widthwise-tab-defining folding line being positioned offset from the second widthwise edge by the box height;

the second primary lengthwise-tab-defining folding line traversing perpendicular from the first widthwise edge to the second widthwise edge;

the second primary lengthwise-tab-defining folding line being positioned offset from the second lengthwise edge by the box height;

the second long-side folding line being distributed along the second primary lengthwise-tab-defining folding line adjacent to the second primary widthwise-tab-defining folding line;

the second short-side folding line being distributed along the second primary widthwise-tab-defining folding line adjacent to the second primary lengthwise-tab-defining folding line;

the second hypothenuse folding line terminally intersecting the second long-side folding line offset from the second short-side folding line; and the second hypothenuse folding line terminally intersecting the second short-side folding line offset from the second long-side folding line.

12. The volume-adjustable package box as claimed in claim 11 comprising:

the second triangular-shaped folding pattern further comprising a second primary lengthwise-tab-interfacing folding line and a second primary widthwise-tab-interfacing folding line;

the second primary lengthwise-tab-interfacing folding line traversing perpendicular from the second primary lengthwise-tab-defining folding line to the second lengthwise edge;

a vertex between the second long-side folding line and the second hypothenuse folding line terminally intersecting the second primary lengthwise-tab-interfacing folding line;

the second primary widthwise-tab-interfacing folding line traversing perpendicular from the second primary widthwise-tab-defining folding line to the second widthwise edge; and a vertex between the second short-side folding line and the second hypothenuse folding line terminally intersecting the second primary widthwise-tab-interfacing folding line.

13. The volume-adjustable package box as claimed in claim 1 comprising:

the foldable piece of boxing material further comprising a first tear-starting feature;

the first tear-starting feature being positioned in between the cutaway pair of perforated lines; and the first tear-starting feature being positioned in between the first widthwise edge and the backing pair of folding lines.

14. The volume-adjustable package box as claimed in claim 1 comprising:

the foldable piece of boxing material further comprising a second tear-starting feature;

the second tear-starting feature being positioned in between the cutaway pair of perforated lines; and the second tear-starting feature being positioned in between the second widthwise edge and the backing pair of folding lines.

* * * * *